US009243842B2

(12) United States Patent
Price

(10) Patent No.: US 9,243,842 B2
(45) Date of Patent: Jan. 26, 2016

(54) COMBINED SYNTHESIS GAS SEPARATION AND LNG PRODUCTION METHOD AND SYSTEM

(75) Inventor: Brian C. Price, Parker, TX (US)

(73) Assignee: Black & Veatch Corporation, Overland Park, KS (US)

( * ) Notice: Subject to any disclaimer, the term of this patent is extended or adjusted under 35 U.S.C. 154(b) by 1359 days.

(21) Appl. No.: 12/069,962

(22) Filed: Feb. 15, 2008

(65) Prior Publication Data

US 2009/0205367 A1 Aug. 20, 2009

(51) Int. Cl.
*F25J 3/00* (2006.01)
*F25J 3/02* (2006.01)

(52) U.S. Cl.
CPC ..... *F25J 3/0223* (2013.01); *F25J 3/0233* (2013.01); *F25J 3/0271* (2013.01); *F25J 2200/02* (2013.01); *F25J 2200/74* (2013.01); *F25J 2205/04* (2013.01); *F25J 2215/04* (2013.01); *F25J 2240/02* (2013.01); *F25J 2270/12* (2013.01); *F25J 2270/42* (2013.01); *F25J 2270/66* (2013.01)

(58) Field of Classification Search
CPC ..... F25J 3/00; F25J 3/0223; F25J 3/0233; F25J 3/0271; F25J 2200/02; F25J 2200/74; F25J 2270/66; F25J 2215/04; F25J 2240/02; F25J 2270/12; F25J 2270/42; F25J 2205/04
USPC ..... 62/620, 920, 931, 934, 611–613, 62/617–619, 623
See application file for complete search history.

(56) References Cited

U.S. PATENT DOCUMENTS

| | | | | |
|---|---|---|---|---|
| 2,976,695 | A | 10/1961 | Meade | |
| 3,191,395 | A | 6/1965 | Maher et al. | |
| 3,210,953 | A | 10/1965 | Reed | |
| 3,271,967 | A | 9/1966 | Karbosky | |
| 3,596,472 | A | 8/1971 | Streich | |
| 3,729,944 | A | 5/1973 | Kelley et al. | |
| 3,800,550 | A | 4/1974 | Delahunty | |
| 3,932,154 | A | 1/1976 | Coers et al. | |
| 4,033,735 | A | 7/1977 | Swenson | |
| 4,036,028 | A | 7/1977 | Mandrin | |
| 4,217,759 | A * | 8/1980 | Shenoy | 62/622 |
| 4,249,387 | A | 2/1981 | Crowley | |
| 4,311,496 | A * | 1/1982 | Fabian | 62/630 |
| 4,411,677 | A | 10/1983 | Pervier et al. | |
| 4,525,187 | A * | 6/1985 | Woodward et al. | 62/627 |
| 4,584,006 | A | 4/1986 | Apffel | |

(Continued)

FOREIGN PATENT DOCUMENTS

| | | |
|---|---|---|
| JP | 200018049 | 1/2000 |
| JP | 20025398 | 1/2002 |

(Continued)

OTHER PUBLICATIONS

Gas Processors Suppliers Association (GPSA) Engineering Databook, Section 16, "Hydrocarbon Recovery," p. 16-13 through 16-20, 12th ed. (2004).

*Primary Examiner* — Frantz Jules
*Assistant Examiner* — Webeshet Mengesha
(74) *Attorney, Agent, or Firm* — Hovey Williams LLP

(57) ABSTRACT

A method and system for the separation of a synthesis gas and methane mixture which contains carbon monoxide, hydrogen and methane with the process producing synthesis gas and liquid natural gas (LNG).

16 Claims, 2 Drawing Sheets

(56) References Cited

U.S. PATENT DOCUMENTS

| | | | | | |
|---|---|---|---|---|---|
| 4,662,919 | A | | 5/1987 | Davis | |
| 4,676,812 | A | * | 6/1987 | Kummann | 62/622 |
| 4,707,170 | A | | 11/1987 | Ayres et al. | |
| 4,714,487 | A | | 12/1987 | Rowles | |
| 4,720,294 | A | * | 1/1988 | Lucadamo et al. | 62/627 |
| 4,727,723 | A | | 3/1988 | Durr | |
| 4,869,740 | A | * | 9/1989 | Campbell et al. | 62/621 |
| 4,878,932 | A | | 11/1989 | Phade et al. | |
| 5,051,120 | A | | 9/1991 | Pahade et al. | |
| 5,148,680 | A | | 9/1992 | Dray | |
| 5,182,920 | A | | 2/1993 | Matsuoka et al. | |
| 5,275,005 | A | | 1/1994 | Campbell et al. | |
| 5,351,491 | A | * | 10/1994 | Fabian | 62/621 |
| 5,377,490 | A | | 1/1995 | Howard et al. | |
| 5,379,597 | A | | 1/1995 | Howard et al. | |
| 5,398,497 | A | | 3/1995 | Suppes | |
| 5,497,626 | A | | 3/1996 | Howard et al. | |
| 5,502,972 | A | | 4/1996 | Howard et al. | |
| 5,555,748 | A | | 9/1996 | Campbell et al. | |
| 5,566,554 | A | | 10/1996 | Vijayaraghavan et al. | |
| 5,568,737 | A | | 10/1996 | Campbell et al. | |
| 5,596,883 | A | * | 1/1997 | Bernhard et al. | 62/618 |
| 5,615,561 | A | | 4/1997 | Houshmand et al. | |
| 5,657,643 | A | | 8/1997 | Price | |
| 5,771,712 | A | | 6/1998 | Campbell et al. | |
| 5,791,160 | A | | 8/1998 | Mandler et al. | |
| 5,799,507 | A | | 9/1998 | Wilkinson et al. | |
| 5,881,569 | A | | 3/1999 | Campbell et al. | |
| 5,890,377 | A | | 4/1999 | Foglietta | |
| 5,890,378 | A | | 4/1999 | Rambo et al. | |
| 5,950,453 | A | | 9/1999 | Bowen et al. | |
| 5,979,177 | A | | 11/1999 | Sumner et al. | |
| 5,983,664 | A | | 11/1999 | Campbell et al. | |
| 5,983,665 | A | * | 11/1999 | Howard et al. | 62/623 |
| 5,992,175 | A | | 11/1999 | Yao et al. | |
| 6,003,603 | A | * | 12/1999 | Breivik et al. | 166/357 |
| 6,021,647 | A | | 2/2000 | Ameringer et al. | |
| 6,023,942 | A | | 2/2000 | Thomas et al. | |
| 6,035,651 | A | | 3/2000 | Carey | |
| 6,053,008 | A | | 4/2000 | Arman et al. | |
| 6,070,430 | A | * | 6/2000 | McNeil et al. | 62/620 |
| 6,085,546 | A | | 7/2000 | Johnston | |
| 6,105,390 | A | | 8/2000 | Bingham et al. | |
| 6,112,550 | A | | 9/2000 | Bonaquist et al. | |
| 6,182,469 | B1 | | 2/2001 | Campbell et al. | |
| 6,260,380 | B1 | * | 7/2001 | Arman et al. | 62/646 |
| 6,266,977 | B1 | | 7/2001 | Howard et al. | |
| 6,295,833 | B1 | | 10/2001 | Hoffart et al. | |
| 6,311,516 | B1 | | 11/2001 | Key et al. | |
| 6,311,519 | B1 | | 11/2001 | Gourbier et al. | |
| 6,330,811 | B1 | | 12/2001 | Arman et al. | |
| 6,363,728 | B1 | | 4/2002 | Udischas et al. | |
| 6,367,286 | B1 | * | 4/2002 | Price | 62/613 |
| 6,401,486 | B1 | | 6/2002 | Lee et al. | |
| 6,405,561 | B1 | | 6/2002 | Mortko et al. | |
| 6,412,302 | B1 | * | 7/2002 | Foglietta | 62/611 |
| 6,425,263 | B1 | | 7/2002 | Bingham et al. | |
| 6,425,266 | B1 | | 7/2002 | Roberts | |
| 6,427,483 | B1 | | 8/2002 | Rashad et al. | |
| 6,438,994 | B1 | | 8/2002 | Rashad et al. | |
| 6,449,982 | B1 | | 9/2002 | Fischer | |
| 6,449,983 | B2 | | 9/2002 | Pozivil | |
| 6,460,350 | B2 | | 10/2002 | Johnson et al. | |
| 6,560,989 | B1 | | 5/2003 | Roberts et al. | |
| 6,578,379 | B2 | | 6/2003 | Paradowski | |
| 6,581,410 | B1 | | 6/2003 | Johnson et al. | |
| 6,662,589 | B1 | | 12/2003 | Roberts et al. | |
| 6,725,688 | B2 | | 4/2004 | Elion et al. | |
| 6,745,576 | B1 | | 6/2004 | Granger | |
| 6,823,691 | B2 | | 11/2004 | Ohta | |
| 6,823,692 | B1 | | 11/2004 | Patel et al. | |
| 6,915,662 | B2 | | 7/2005 | Wilkinson et al. | |
| 6,925,837 | B2 | | 8/2005 | Eaton | |
| 6,945,075 | B2 | | 9/2005 | Wilkinson et al. | |
| 7,051,553 | B2 | | 5/2006 | Mak et al. | |
| 7,069,744 | B2 | | 7/2006 | Patel et al. | |
| 7,100,399 | B2 | | 9/2006 | Eaton | |
| 7,107,788 | B2 | | 9/2006 | Patel et al. | |
| 7,114,342 | B2 | | 10/2006 | Oldham et al. | |
| 7,152,428 | B2 | | 12/2006 | Lee et al. | |
| 7,152,429 | B2 | | 12/2006 | Paradowski | |
| 7,159,417 | B2 | | 1/2007 | Foglietta et al. | |
| 7,191,617 | B2 | | 3/2007 | Cuellar et al. | |
| 7,204,100 | B2 | | 4/2007 | Wilkinson et al. | |
| 7,210,311 | B2 | | 5/2007 | Wilkinson et al. | |
| 7,216,507 | B2 | | 5/2007 | Cuellar et al. | |
| 7,219,513 | B1 | | 5/2007 | Mostafa | |
| 7,234,321 | B2 | | 6/2007 | Maunder et al. | |
| 7,234,322 | B2 | | 6/2007 | Hahn et al. | |
| 7,266,975 | B2 | | 9/2007 | Hupkes et al. | |
| 7,310,972 | B2 | | 12/2007 | Yoshida et al. | |
| 7,316,127 | B2 | | 1/2008 | Huebel et al. | |
| 7,357,003 | B2 | | 4/2008 | Ohara et al. | |
| 7,484,385 | B2 | | 2/2009 | Patel et al. | |
| 7,614,241 | B2 | | 11/2009 | Mostello | |
| 7,644,676 | B2 | | 1/2010 | Lee et al. | |
| 7,713,497 | B2 | | 5/2010 | Mak | |
| 7,793,517 | B2 | | 9/2010 | Patel et al. | |
| 7,818,979 | B2 | | 10/2010 | Patel et al. | |
| 7,841,288 | B2 | | 11/2010 | Lee et al. | |
| 7,856,847 | B2 | | 12/2010 | Patel et al. | |
| 8,505,312 | B2 | | 8/2013 | Mak et al. | |
| 8,549,876 | B2 | | 10/2013 | Kaart et al. | |
| 8,650,906 | B2 | | 2/2014 | Price et al. | |
| 8,671,699 | B2 | | 3/2014 | Rosetta et al. | |
| 2002/0166336 | A1 | | 11/2002 | Wilkinson et al. | |
| 2003/0029190 | A1 | | 2/2003 | Trebble | |
| 2003/0046953 | A1 | | 3/2003 | Elion et al. | |
| 2004/0159122 | A1 | * | 8/2004 | Patel et al. | 62/620 |
| 2005/0056051 | A1 | | 3/2005 | Roberts et al. | |
| 2005/0204625 | A1 | | 9/2005 | Briscoe et al. | |
| 2006/0260355 | A1 | | 11/2006 | Roberts et al. | |
| 2006/0260358 | A1 | | 11/2006 | Kun | |
| 2007/0157663 | A1 | | 7/2007 | Mak et al. | |
| 2007/0231244 | A1 | * | 10/2007 | Shah et al. | 423/437.1 |
| 2008/0264076 | A1 | | 10/2008 | Price et al. | |
| 2009/0193846 | A1 | * | 8/2009 | Foral et al. | 62/620 |
| 2009/0205367 | A1 | | 8/2009 | Price | |
| 2009/0217701 | A1 | | 9/2009 | Minta et al. | |
| 2010/0043488 | A1 | * | 2/2010 | Mak et al. | 62/620 |
| 2010/0064725 | A1 | | 3/2010 | Chieng et al. | |
| 2010/0132405 | A1 | | 6/2010 | Nilsen | |
| 2011/0289963 | A1 | | 12/2011 | Price | |
| 2012/0000245 | A1 | | 1/2012 | Currence et al. | |
| 2012/0090324 | A1 | | 4/2012 | Rosetta et al. | |
| 2012/0137726 | A1 | | 6/2012 | Currence et al. | |
| 2013/0213807 | A1 | | 8/2013 | Hanko et al. | |

FOREIGN PATENT DOCUMENTS

| | | |
|---|---|---|
| JP | 2003232226 | 8/2003 |
| WO | 2005045338 | 5/2005 |

* cited by examiner

COMBINED SYNTHESIS GAS SEPARATION AND LNG PRODUCTION METHOD AND SYSTEM

FIELD OF THE INVENTION

The present invention relates to a process and a system for the separation of a synthesis gas and methane mixture which contains carbon monoxide, hydrogen and methane with the process and system producing synthesis gas and liquid methane gas (LNG).

BACKGROUND OF THE INVENTION

In many processes for the production of synthetic hydrocarbonaceous products, such as paraffins, alcohols and the like, it is necessary to produce a synthesis gas stream of carbon monoxide and hydrogen in proper proportions for reaction as a feed stream over a suitable catalyst. Fischer-Tropsch processes are well known and are frequently used for this purpose. The synthesis gas mixture may be produced by a number of processes, such as downhole gasification of coal or other hydrocarbonaceous materials, steam reforming of methane, partial gasification of hydrocarbonaceous materials, such as coal, at an earth surface and the like. In such processes, the carbon monoxide and hydrogen are frequently produced in combination with methane, acid gases, such as hydrogen sulfide, carbon dioxide and the like, as well possibly tars, particulates and the like. These materials are detrimental to the catalytic process for the conversion of the carbon monoxide and hydrogen into other products. Accordingly, a synthesis gas mixture is typically treated after production to remove tars, particulates and water as necessary by known technologies. Similarly, carbon dioxide and hydrogen sulfide are readily removed by known techniques, such as amine scrubbing and the like.

The production of LNG can be accomplished with a mixed refrigeration system, as well as other types of refrigeration systems such as cascade systems and the like. The mixed refrigeration systems shown in U.S. Pat. No. 4,033,735 issued Jul. 5, 1977 to Leonard K. Swenson (Swenson) and assigned to J. F. Pritchard and Company and U.S. Pat. No. 5,657,643 issued Aug. 19, 1997 to Brian C. Price (Price) and assigned to The Pritchard Corporation, are illustrative of mixed refrigerant processes for the liquefaction of natural gas. Both these references are hereby incorporated in their entirety by reference.

Normally the production of LNG, which is primarily liquefied methane, can be accomplished with a mixed refrigeration system such as those described above, but the presence of carbon monoxide and hydrogen in the stream require additional processing, since the carbon monoxide and hydrogen will not condense at LNG condensation temperatures. The primary separation step typically used is a synthesis gas fractionator, which requires an overhead temperature of nearly −177° C. In order to perform this separation, low temperature refrigerant is required for the fractionator condenser system. Nitrogen is a good choice for this system to provide this low temperature utility.

As a result, a continuing search has been directed to improved processes for the separation of carbon monoxide and hydrogen from methane economically.

SUMMARY OF THE INVENTION

According to the present invention, this separation is accomplished by the separation and liquefaction of methane in a method for separating a gas stream containing carbon monoxide, hydrogen and methane into a gas stream containing carbon monoxide and hydrogen and a liquefied gas stream containing methane, the method comprising: cooling a feed gas stream to a temperature from about −145 to about −160° C. at a pressure from about 4.0 to about 6.0 MPa to produce a cold mixed gas and liquid stream; and, fractionating the cold mixed gas and liquid stream to produce a carbon monoxide and hydrogen stream and a liquefied gas stream comprising methane.

The invention further comprises a system for separating a feed gas stream containing carbon monoxide, hydrogen and methane into a carbon monoxide/hydrogen ($CO/H_2$) gas stream containing carbon monoxide and hydrogen and a liquefied gas stream containing methane, the system comprising: a refrigeration heat exchanger having a feed gas stream inlet, a refrigerant inlet, a refrigerant expansion valve, a spent refrigerant outlet and a cold mixed gas and liquid stream outlet; a cold separator having a cold mixed gas and liquid stream inlet in fluid communication with the cold mixed gas and liquid stream outlet from the refrigerant heat exchanger and having a cold gas stream outlet and a cold liquid stream outlet; a fractionator having a cold gas stream inlet in fluid communication with the cold gas stream outlet from the cold separator and adapted to pass the cold gas stream into the fractionator, the fractionator having a cold liquid stream inlet in fluid communication with the cold liquid outlet stream and adapted to pass the cold liquid stream into the fractionator, a fractionator overhead gas outlet, a reflux inlet and a liquefied gas stream outlet; a $CO/H_2$ gas stream chilling heat exchanger adapted to pass a fractionator overhead gas stream in heat exchange contact with a chilling stream to produce a chilled $CO/H_2$ gas stream via a chilled $CO/H_2$ gas stream outlet; a reflux drum having at least one of a fractionator overhead gas inlet and a chilled $CO/H_2$ gas stream inlet, a reflux drum outlet in fluid communication with the fractionator reflux inlet and a reflux drum overhead gas outlet; a liquefied gas stream heat exchanger in fluid communication with the reflex drum overhead gas outlet and the liquefied gas stream from the fractionator liquefied gas stream outlet to warm the reflux drum overhead gas outlet stream to produce a warmed reflux drum overhead gas stream and a chilled liquefied gas stream for discharge as a product stream; and, a first compressor in fluid communication with and driven by the cold gas stream from the cold gas stream outlet from the cold separator to produce an expanded cold gas stream and drive a second compressor in fluid communication with the warmed reflux drum overhead gas stream to compress the reflux drum overhead gas stream to produce a $CO/H_2$ gas stream.

DESCRIPTION OF PREFERRED EMBODIMENTS

According to the present invention, the carbon monoxide and hydrogen are recovered as a gas, with the methane being recovered as LNG.

Desirably the feed pressure ranges from about 4.5 to about 6.0 MPa. Further it is required that the feed be treated for the removal of tars, particulates, acid gases, water and the like prior to passing it according to the method of the present invention so that the stream is substantially pure carbon monoxide, hydrogen and methane.

Figure 1:
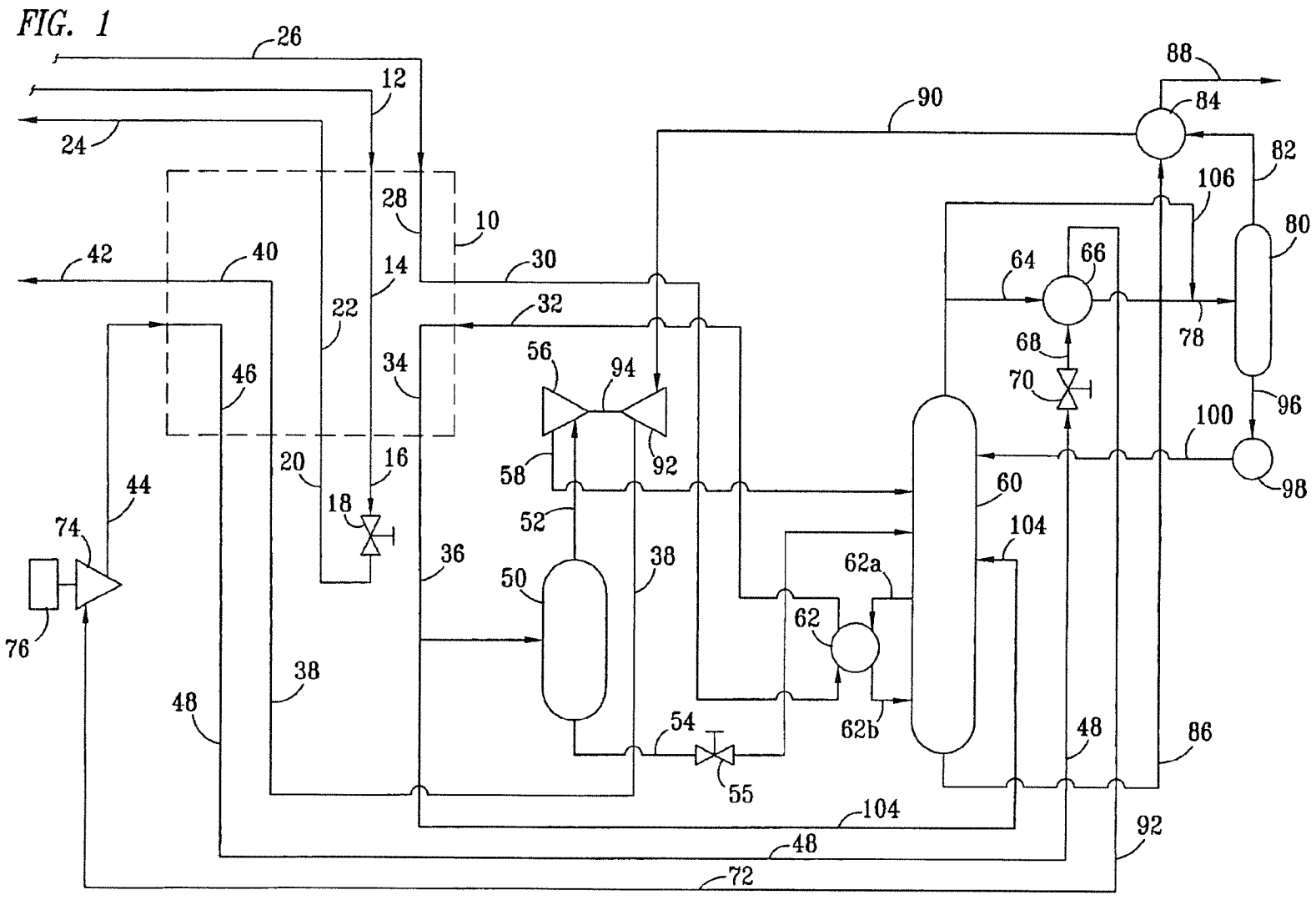
FIG. 1 shows an embodiment of the present invention.

If the feed pressure is below 4.5 MPas a feed compressor should be considered to boost the feed gas to 4.5 MPa or above to maintain the efficiency of the process as shown in FIG. 1. The exact pressure is determined by the technical and economic analysis of the process conditions.

If the feed pressure is low, i.e., 2.5 MPa, the process can be operated without the expander/compressor unit. The efficiency will be decreased but the process can achieve the desired separation with the process as disclosed.

Another key parameter is the pressure specification of the synthesis gas (carbon dioxide and hydrogen) produced from the unit. If this gas is at a pressure above 2.4 MPa, additional feed or outlet pressure must be provided. If the synthesis gas is produced at a substantially lower pressure than 2.5 MPa, the process efficiency can be increased or the inlet compression (if used) can be decreased while maintaining the same overall process efficiency.

Figure 2:
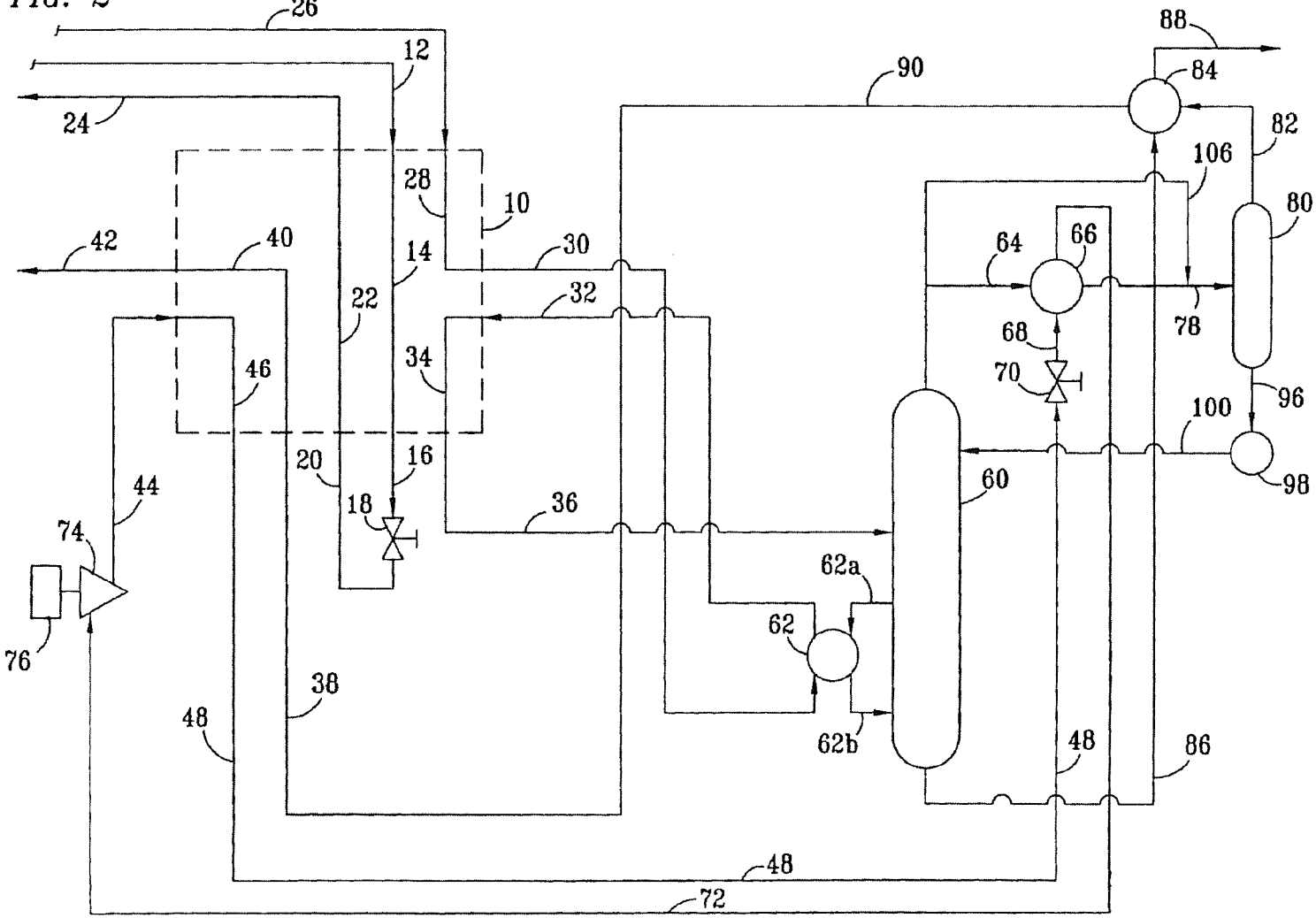
FIG. 2 shows an alternate embodiment of the present invention.

An alternative embodiment shown in FIG. 2 is considered to be more effective when the inlet gas pressure is less than about 2.5 MPa.

In the embodiment shown in FIG. 1, a refrigeration heat exchanger 10 is used as the principal heat exchanger 10. In this vessel, a mixed refrigerant is charged through a feed line 12. The mixed refrigerant is typically produced by recovering the spent refrigerant from the heat exchanger, compressing and cooling the spent refrigerant, separating the liquid and gas components comprising the mixed refrigerant and recombining these components for recharging to heat exchanger 10. Processes of this type, as noted previously, have been described in the incorporated references.

The mixed refrigerant enters the heat exchanger 10 from a line 12 and moves through a heat exchange passageway 14 to a cold refrigerant line 16 which then passes the mixed refrigerant through an expansion valve 18 to produce a lower temperature expanded refrigerant which is passed through an expanded refrigerant line 20 to a heat exchange passage 22 with the mixed refrigerant continuously evaporating as it passes upwardly through heat exchange passage 22. The spent refrigerant is recovered through a line 24 and passed to regeneration as described for use as fresh mixed refrigerant. The feed gas is charged through a line 26 and passes through heat exchange passageway 28 to discharge through a line 30 which contains a cooled feed gas at a temperature from about −70 to about −100° C. The cooled gas is then passed via a line 30 to heat a reboiler 62 for a fractionation column 60. The gas in line 30 is further cooled by heat exchange in reboiler 62. The gas is then returned via a line 32 to heat exchanger 10 and passed through a heat exchange passageway 34 to produce a cold mixed stream containing liquefied methane, carbon monoxide and hydrogen, which is recovered in a line 36 at a temperature from about −145 to about −160° C. In some instances, it may be desirable to pass the stream from line 36 into a line 104 and directly into fractionator 60. In most instances, however, in this embodiment this stream is passed into a cold separator 50 where the liquid, which contains primarily methane, is recovered and passed through a line 54 and a control valve 55 to injection into fractionating column 60, typically at a level below the injection point of an overhead stream 52 from cold separator 50.

The overhead stream from cold separator 50, which comprises primarily carbon monoxide and hydrogen, is passed from cold separator 50 to an expander 56 via a line 52. The expanded gas stream is passed via a line 58 to fractionator 60 at a level typically above the level at which the liquid stream from line 54 is injected.

The carbon monoxide and hydrogen are separated from the liquid methane in fractionator 60 to produce the desired products. The bottom stream from fractionator 60 is recovered through a line 86 and passed through line 86 to a heat exchanger 84 where it is further cooled by the $CO/H_2$ stream recovered as the overhead 64 from fractionator 60. The resulting liquefied methane (LNG) is recovered through a line 88 as a valuable product from the process.

To achieve the desired separation, it may be possible in some instances to simply pass the stream recovered as an overhead stream in line 64 through a line 106 into line 78 and then into a reflux drum 80. In reflux drum 80, a gaseous stream 82 is recovered and passed to heat exchanger 84 and then through a line 90 to drive a compressor 92, shaft coupled by a shaft 94 to compressor 56 to produce a compressed stream of $CO/H_2$ gas which is then passed via a line 38 to a heat exchange passageway 40 in heat exchanger 10 to recover refrigeration values from the $CO/H_2$ gas stream which is then discharged through a line 42 as a product stream. In a preferred operation, the overhead gas from fractionator 60 is passed through a line 64 to heat exchange with a stream which is desirably liquid nitrogen in a heat exchanger 66. The chilled carbon monoxide and hydrogen is then passed via a line 78 to a reflux drum 80 where a stream of carbon monoxide and hydrogen is recovered through a line 96 and passed to a pump 98 and then through a line 100 as a reflux stream to fractionation column 60.

The nitrogen is provided as a recycling nitrogen stream which is passed through a line 72 after heat exchange with the carbon monoxide and hydrogen in heat exchanger 66 to a compressor 74 powered by a motor 76 wherein the nitrogen stream is compressed and passed via a line 44 through a heat exchange passageway 46 in fractionator 10 and then passed via a line 48 back to an expansion valve 70, a line 68 and heat exchanger 66. The use of this nitrogen stream chills the $CO/H_2$ gas stream to a temperature from about −165 to about −190° C. and preferably from about −175 to about −180° C. at a pressure from about 1 to about 2 MPa.

This very cold $CO/H_2$ gas stream is ideally suited for use in heat exchanger 84 to further cool the liquid methane stream to produce the desired LNG. By this process the primary cooling is achieved in heat exchanger 10, which as indicated previously, may be a multi-component refrigerant heat exchange vessel, a cascade cooling process or the like. This enables the recovery of both the LNG and the carbon monoxide and hydrogen relatively economically since all of the heat removal is accomplished either in refrigerant vessel 10 or by the use of expansion or compression of streams cooled in heat exchanger 10. This is a much more efficient system than processes which directly use other cooling systems to cool the entire $CO/H_2$ and methane stream to a suitably low temperature for separation. Further, when the entire stream is cooled for separation, it still remains to fractionate the cooled stream into $CO/H_2$ and methane stream.

Having described the process, a specific example will be described. Particularly, it is necessary that the gas sent to the heat exchanger be treated to remove undesired components and dehydrated prior to charging it to the heat exchanger for synthesis gas separation and LNG production. Desirably this gas is at an elevated pressure, such as about 4.8 MPa, although the process will operate at higher inlet pressures at increased efficiency and at lower inlet pressures with decreased efficiency.

The feed gas enters the refrigeration heat exchanger unit where it is chilled to about −80° C. in the first pass of the heat exchanger. The gas is then used to reboil the synthesis gas fractionator 62. The gas then returns to the main heat exchanger where it is further chilled to from about −145 to about −160° C. and preferably to about −150 to about −152° C. The cold gas is then separated in a cold separator with the $CO/H_2$ gas vapor being sent to an expander section where it is expanded and sent to a synthesis gas fractionator at a temperature from about −160 to about −188° C. and preferably from about −170 to about −188° C. The liquid from the cold separator is then fed to the fractionator lower down the column. The fractionator separates the $CO/H_2$ as an overhead stream and liquid methane as a bottom stream. The overhead condenser operates at a temperature from about −165 to about −190° C. and preferably about −177° C. This cooling is provided by a nitrogen refrigeration loop which can provide refrigeration at a temperature from about −175 to about −198° C. and preferably at about −183° C. by use of an expansion valve 70 in line 48. The methane is exchanged with the overhead stream to sub-cool the methane to about −163° C. The $CO/H_2$ overhead stream is then sent to compressor 92 and then to heat exchanger 10 to recover the cold from the stream. The $CO/H_2$ gas stream then exits the process at about 30° C. and at about 2.4 MPa.

The process is desirably designed specifically with a given feed stream in mind so that the thermodynamic considerations may be fully evaluated to design the process. In some instances, it may not be necessary to separate the mixed gas and liquid stream recovered through line 36 but in most instances it is considered that this will be desirable. Further, it is considered that it is desirable to cool the overhead stream from fractionator 60 using the nitrogen loop as described, although in some instances it may be possible to eliminate the nitrogen and simply pass the overhead stream through a line 106 to the reflux drum 80.

While the process discussed above is preferred, when the pressure of the feed gas is from about 4 to about 6 MPa's, an alternative process may be desirable when the pressure is lower. While the process disclosed above can be used with pressures as low as 2.5 MPa's or, as discussed, the gas feed can be compressed prior to charging to the process, it may be desirable to use an alternate process in some instances.

In FIG. 2, such an alternate process is shown. While this process is similar to that shown in FIG. 1, it will be noted that no cold separation vessel 50 is included and no expander is used to cool the gas from the cold separator to a fractionator at a level above the injection point from the liquid. Nor is any compressor used to compress, and thereby heat, the $CO/H_2$ gas stream recovered from heat exchanger 44 and subsequently passed to heat exchanger 10. In other aspects, the processes are very similar although the temperatures may vary dependent upon the particular method of operation chosen. In both instances nitrogen is used to as a stream for passage through line 48 to expansion valve 70 to produce a cold stream for use in heat exchanger 66 with the nitrogen then being recycled via line 72 and a compressor 74 powered by motor 76 to a line 44. The compressed nitrogen is passed through line 44 and line 46 into heat exchanger 10 to produce a cold nitrogen stream which is thereafter expanded, as noted in expansion valve 70.

In both processes most of the cooling is accomplished, directly or indirectly, in heat exchanger 10. Expansion valve 70 is used with the nitrogen stream, which is recovered via line 72 and returned to a compressor 74 for recompression and cooling in heat exchanger 10. As well known, the compression of the gaseous stream increases its temperature so that when the temperature is decreased in heat exchanger 10 the stream is ready for recirculation through line 48 back to expansion valve 70 where it is cooled by expansion to produce a cold stream. In other aspects, the operation of the process shown in FIG. 2 is the same as in FIG. 1 with respect to the process flows. The process is readily operated with feed gas stream at pressures from about 1.0 to about 2.5 MPa.

Both of these processes accept streams which are produced by gasification or other processes and which include both methane and $CO/H_2$. Both of these streams are valuable streams and by the processes disclosed, are both separately recovered. The difficulty in processes for separation and recovery of these streams is that while the methane is readily liquefied at the process temperatures, the $CO/H_2$ is not. By the processes disclosed, various heat transfer operations are utilized to optimize the efficiency of the process. This enables the efficient separation and production of both a liquefied gas stream and a $CO/H_2$ stream which is at a suitable temperature for passage to another process or the like.

While the present invention has been described by reference to certain of its preferred embodiments, it is pointed out that the embodiments described are illustrative rather than limiting in nature and that many variations and modifications are possible within the scope of the present invention. Many such variations and modifications may be considered obvious and desirable by those skilled in the art based upon a review of the foregoing description of preferred embodiments.

What is claimed is:

1. A method for co-producing a syngas stream and a liquefied natural gas (LNG) stream from a feed gas stream containing carbon monoxide, hydrogen and methane, the method comprising:

a) cooling a feed gas stream comprising carbon monoxide, hydrogen, and methane and having a pressure less than 6 MPa via indirect heat exchange with a mixed refrigerant stream in a first closed-loop refrigeration cycle to provide a cooled mixed gas and liquid stream, wherein the cooled mixed gas and liquid stream has a temperature from −145 to −160° C.;

b) separating at least a portion of the cooled mixed gas and liquid stream in a fractionator to thereby produce a carbon monoxide and hydrogen enriched overhead vapor stream and a liquefied bottoms stream enriched in methane;

c) cooling at least a portion of the overhead vapor stream via indirect heat exchange with a nitrogen refrigerant stream in an overhead heat exchanger of a second closed-loop refrigeration cycle to thereby provide a two-phase overhead stream and a warmed nitrogen refrigerant stream;

d) separating the two-phase overhead stream into a predominantly liquid portion and a predominantly vapor portion;

e) compressing at least a portion of the predominantly vapor portion to thereby provide a compressed vapor stream;

f) introducing at least a portion of the predominantly liquid portion into the fractionator as a reflux stream and using at least a portion of the compressed vapor stream to perform at least a part of the cooling of step (a);

g) producing a vapor phase syngas product stream and a liquid LNG product stream, wherein the syngas product stream comprises at least a portion of the predominantly vapor portion of the two-phase overhead stream separated in step (d), wherein the LNG product stream comprises at least a portion of the liquefied bottoms stream withdrawn from the fractionator, h) subsequent to the cooling of step c), compressing the warmed nitrogen refrigerant stream to thereby provide a compressed nitrogen refrigerant stream;

i) cooling at least a portion of the compressed nitrogen refrigerant stream via indirect heat exchange to provide a cooled nitrogen refrigerant stream, wherein the cooling is performed with at least one of at least a portion of the mixed refrigerant stream used during the cooling of step a) and at least a portion of the compressed vapor stream;

j) expanding at least a portion of the cooled nitrogen refrigerant stream to provide a cooled, expanded nitrogen refrigerant stream, wherein the cooled, expanded nitrogen refrigerant stream is used to cool the overhead vapor stream during the cooling of step c); and k) after heat exchange with the overhead vapor stream, passing the warmed nitrogen refrigerant stream from the outlet of the overhead heat exchanger to the compressor.

2. The method of claim 1 further comprising prior to the separating of step (b), introducing at least a portion of the cooled mixed gas and liquid stream to a cold separator to separate the stream into an overhead gas stream and a bottoms liquid stream; expanding the overhead gas stream to form an expanded gas stream; and introducing the expanded gas stream and the bottoms liquid stream into the fractionator to undergo the separating of step (b).

3. The method of claim 1 wherein said cooling of step (a) comprises cooling the feed gas stream to a temperature in the range of from −70 to −100° C. in a first heat exchange passageway of a refrigeration heat exchanger to provide a cooled feed gas stream and subsequently cooling the cooled feed gas stream to a temperature in the range of from −145° C. to −160° C. in a second heat exchange passageway of the refrigeration heat exchanger.

4. The method of claim 1 wherein the syngas product stream has a temperature of at least 30° C. and a pressure of at least 2.4 MPa.

5. The method of claim 1 further comprising cooling at least a portion of the liquefied bottoms stream enriched in methane via indirect heat exchange with at least a portion of the carbon monoxide and hydrogen enriched overhead vapor stream withdrawn from the fractionator.

6. A method for co-producing a syngas stream and a liquefied natural gas (LNG) stream from a feed gas comprising carbon monoxide, hydrogen, and methane, the process comprising:

(a) cooling and partially condensing a feed gas stream comprising carbon monoxide, hydrogen, and methane in a first heat exchange passageway of a primary heat exchanger via indirect heat exchange with a first refrigerant stream to thereby provide a cooled two-phase feed stream;

(b) further cooling the cooled two-phase feed stream in a second heat exchange passageway of the primary heat exchanger via indirect heat exchange with the first refrigerant stream to thereby provide a further cooled feed stream;

(c) dividing the further cooled feed stream into a first fraction and a second fraction;

(d) separating the first fraction in a first vapor-liquid separator to thereby provide a first vapor stream rich in hydrogen and carbon monoxide and a first liquid stream rich in methane;

(e) simultaneously with the separating of step (d), introducing the second fraction into a fractionator;

(f) expanding the first vapor stream withdrawn from the first vapor-liquid separator to thereby provide an expanded vapor stream;

(g) introducing the expanded vapor stream and the first liquid stream in the fractionator;

(h) withdrawing a second vapor stream and a second liquid stream from the respective upper and lower portions of the fractionator;

(i) compressing at least a portion of the second vapor stream withdrawn from the fractionator to thereby provide a compressed vapor stream;

(j) using at least a portion of the compressed vapor stream to perform at least a portion of the cooling of step (a);

(k) producing a syngas product stream enriched in carbon monoxide and hydrogen, wherein the syngas product stream comprises at least a portion of the compressed vapor stream;

(l) cooling at least a portion of the second liquid stream withdrawn from the lower portion of the fractionator via indirect heat exchange with at least a portion of the second vapor stream to provide a warmed vapor stream and a cooled second liquid stream, wherein the cooling is performed prior to the compressing of step (i); and (m) recovering an LNG product stream, wherein and the LNG product stream comprises at least a portion of the cooled second liquid stream.

7. The method of claim 6, wherein the vapor portion of the cooled two-phase feed stream comprises predominantly hydrogen and carbon monoxide and the liquid portion of the two-phase fluid stream comprises predominantly methane, wherein the temperature of the first fraction introduced into the vapor-liquid separator is in the range of from −145° C. to −160° C.

8. The method of claim 6, wherein the temperature of the second vapor stream withdrawn from the fractionator is less than −160° C.

9. The method of claim 6, wherein the expanded vapor stream is introduced into the fractionator at a higher vertical elevation than the first liquid stream.

10. The method of claim 6, further comprising, cooling at least a portion of the second vapor stream via indirect heat exchange with a nitrogen refrigerant stream and separating the resulting cooled vapor stream into a liquid portion and a vapor portion in a fractionator reflux drum, wherein at least a portion of the liquid portion of the cooled vapor stream is refluxed into an upper portion of the fractionator.

11. The method of claim 10, further comprising prior to the cooling of the second vapor stream, expanding at least a portion of the nitrogen refrigerant to provide an expanded nitrogen refrigerant stream, wherein at least a portion of the expanded nitrogen refrigerant stream is used to carry out the cooling of the second vapor stream, wherein the temperature of the expanded nitrogen refrigerant stream prior to the cooling is in the range of from −175° C. to −198° C.

12. The method of claim 6, wherein at least a portion of the cooling of step (a) is carried out via indirect heat exchange with mixed refrigerant stream and nitrogen refrigerant stream.

13. A system for co-producing a syngas stream and a liquefied natural gas (LNG) stream, the system comprising:

a main heat exchanger comprising a first cooling pass for cooling an incoming feed gas stream, the first cooling pass comprising a feed gas inlet and a cool fluid outlet, and a second cooling pass for further cooling the feed gas stream, the second cooling pass comprising a cool fluid inlet and a further cooled fluid outlet, the cool fluid inlet of the second heat exchange pass in fluid flow communication with the cool fluid outlet of the first cooling pass;

a vapor-liquid separator for separating the cooled feed gas into a vapor stream and a liquid stream, the vapor-liquid separator comprising a cool fluid inlet, a first vapor outlet, and a first liquid outlet, the cool fluid inlet in fluid communication with the cool fluid outlet of the first cooling pass;

a first expansion device for expanding at least a portion of the vapor stream exiting the vapor-liquid separator, the first expansion device comprising a high pressure fluid inlet and a low pressure fluid outlet, the high pressure fluid inlet in fluid communication with the first vapor outlet of the vapor-liquid separator;

a fractionator for separating at least a portion of the vapor and liquid streams withdrawn from the vapor-liquid separator, the fractionator comprising an upper fluid inlet, a lower fluid inlet, a cooled fluid inlet, a second vapor outlet, and a second liquid outlet, the upper fluid inlet in fluid communication with the low pressure fluid outlet of the first expansion device and the lower fluid inlet in fluid communication with the first liquid outlet of the vapor-liquid separator, and the cooled fluid inlet in fluid communication with the further cooled fluid outlet of the second cooling pass;

a compressor for compressing at least a portion of the vapor stream withdrawn from the fractionator, the compressor comprising a high pressure outlet and a low pressure inlet in fluid communication with the second vapor outlet of the fractionator; and a multi-loop refrigeration system comprising— a closed-loop mixed refrigerant cycle comprising a mixed refrigerant cooling pass having a warm mixed refrigerant inlet and a cooled mixed refrigerant outlet; a mixed refrigerant warming pass having a cool mixed refrigerant inlet and a warmed mixed refrigerant outlet; and a mixed refrigerant expansion valve having a high pressure mixed refrigerant inlet and a low pressure mixed refrigerant outlet, the high pressure mixed refrigerant inlet in fluid communication with the cooled mixed refrigerant outlet of the mixed refrigerant cooling pass and the low pressure mixed refrigerant outlet in fluid communication with the cool mixed refrigerant inlet of the mixed refrigerant warming pass; and a closed-loop nitrogen refrigerant cycle comprising— a condenser having a warm vapor inlet and a cool fluid outlet and a cool nitrogen inlet and a warm nitrogen outlet, the warm vapor inlet in fluid communication with the second vapor outlet of the fractionator;

a nitrogen compressor for compressing the warmed nitrogen refrigerant, the nitrogen compressor having a low pressure nitrogen inlet and a high pressure nitrogen outlet, the low pressure nitrogen inlet in fluid communication with the warm nitrogen outlet of the condenser;

a nitrogen cooling pass disposed within the main heat exchanger for cooling the compressed nitrogen refrigerant, the nitrogen cooling pass comprising a warm nitrogen inlet and a cooled nitrogen outlet, the warm nitrogen inlet of the nitrogen cooling pass in fluid communication with the high pressure nitrogen outlet of the nitrogen compressor; and a nitrogen expansion device for expanding the cooled nitrogen from the nitrogen cooling pass, the nitrogen expansion device having a high pressure nitrogen inlet and a low pressure nitrogen outlet, the high pressure nitrogen inlet in fluid communication with the cooled nitrogen outlet of the nitrogen cooling pass and the low pressure nitrogen outlet in fluid communication with the cool nitrogen inlet of the condenser.

14. The system of claim 13, wherein the fractionator further comprises a reflux inlet, wherein the cool fluid outlet of the condenser is in fluid communication with the reflux inlet of the fractionator.

15. The system of claim 13, further comprising a second heat exchanger for cooling the liquid stream withdrawn from the liquid outlet of the fractionator, the heat exchanger comprising a warm liquid inlet, a cool liquid outlet, a cool fluid inlet, and a warm fluid outlet, the warm liquid inlet in fluid communication with the lower liquid outlet of the fractionator, the cool fluid inlet in fluid communication with the cool vapor outlet of the condenser, the cool liquid outlet configured to discharge an LNG product stream.

16. The system of claim 15, further comprising a syngas warming pass having a cool syngas inlet and a warm syngas outlet, the syngas warming pass disposed within the main heat exchanger, the cool syngas inlet in fluid communication with the high pressure outlet of the compressor and the low pressure outlet of the compressor being in fluid communication with the warm fluid outlet of the second heat exchanger, the warm syngas outlet of the syngas warming pass being configured to discharge a syngas product stream.

* * * * *